United States Patent [19]

Muramatsu et al.

[11] Patent Number: 4,911,601

[45] Date of Patent: Mar. 27, 1990

[54] DEVICE FOR MOVING AND SUPPORTING A STACK OF FOLDED CARTONS IN CARTON AUTOMATIC FEEDING DEVICE FOR A LIQUID FILLING MACHINE

[75] Inventors: Mitsuru Muramatsu; Ryuichiro Tominaga, both of Tokyo, Japan

[73] Assignee: Jujo Paper Co. Ltd., Tokyo, Japan

[21] Appl. No.: 246,048

[22] Filed: Sep. 19, 1988

Related U.S. Application Data

[62] Division of Ser. No. 101,521, Sep. 28, 1987, Pat. No. 4,840,011.

[51] Int. Cl.[4] ..... B65B 21/02

[52] U.S. Cl. ..... 414/417; 414/790.2; 198/468.11; 198/468.2

[58] Field of Search ..... 198/468.11, 468.2, 419.1, 198/419.2; 414/416, 417, 404, 789.9, 790.2, 790.3, 907; 53/152, 542, 543

[56] References Cited

U.S. PATENT DOCUMENTS

| | | | |
|---|---|---|---|
| 3,913,643 | 10/1975 | Lambert | 414/417 X |
| 3,960,280 | 6/1976 | Stolzer | 414/417 X |
| 4,545,715 | 10/1985 | Seefeldt | 198/468.2 X |
| 4,611,705 | 9/1986 | Fluck | 414/798.9 |
| 4,696,615 | 9/1987 | Ettischer et al. | 414/416 X |
| 4,723,883 | 2/1988 | Smith | 414/789.9 X |
| 4,756,400 | 7/1988 | Funo et al. | 198/468.11 X |

FOREIGN PATENT DOCUMENTS

| | | | |
|---|---|---|---|
| 0111432 | 6/1984 | European Pat. Off. | 414/790.2 |
| 2711132 | 9/1978 | Fed. Rep. of Germany | 198/468.11 |
| 0152593 | 11/1979 | Japan | 414/417 |
| 0088537 | 4/1987 | Japan | 414/417 |
| 1366349 | 1/1988 | U.S.S.R. | 414/417 |

*Primary Examiner*—Robert J. Spar
*Assistant Examiner*—James R. Bidwell
*Attorney, Agent, or Firm*—Armstrong, Nikaido, Marmelstein, Kubovcik & Murray

[57] ABSTRACT

Apparatus for moving a stack of folded cartons from a first container to a second container in an automatic carton feeding apparatus and providing support for the stack of folded cartons to prevent individual ones of the folded cartons from tumbling out of the stack during such movement. Two piston and cylinder assemblies are utilized for engaging opposite ends of the stack of folded cartons.

5 Claims, 4 Drawing Sheets

DEVICE FOR MOVING AND SUPPORTING A STACK OF FOLDED CARTONS IN CARTON AUTOMATIC FEEDING DEVICE FOR A LIQUID FILLING MACHINE

This is a division, of application Ser. No. 101,521 filed Sept. 28, 1987, now U.S. Pat. No. 4,840,011.

BACKGROUND OF THE INVENTION

The present invention, is a device to automatically feed cardboard cartons to a liquid filling machine for retailing milk, juice and other liquids and, more specifically, relates to a device for laterally cutting an adhesive tape applied onto surfaces extending from the upper to lower side of a carton case prior to the longitudinal cutting of the tape to turn open the outer flaps of the case which contains cartons superposed in a folded-up state.

Such conventional laterally cutting devices have undesirable disadvantages such as early devices are allowed to cut the upper and lower ends of the flaps simultaneously with the lateral cutting of the tape.

SUMMARY OF THE INVENTION

The purpose of the present invention is to provide a device capable of laterally cutting only the tape over the flaps of said case without cutting the superfluous portions of the upper and lower end of the flaps.

The present invention consists in providing upper and lower lateral cutting cutters which protrude at an angle to the end corners of the case, moving the case horizontally and normal to the longitudinal dimension of the case, and moving each of the lateral cutting cutters by a projecting and retracting mechanism such as an air cylinder or the like.

DETAILED DESCRIPTION OF THE PREFERRED EMBODIMENT

With reference to FIG. 1 to FIG. 5 a description of a device for laterally cutting the tape applied to the flaps of a case is as follows.

Figure 1:
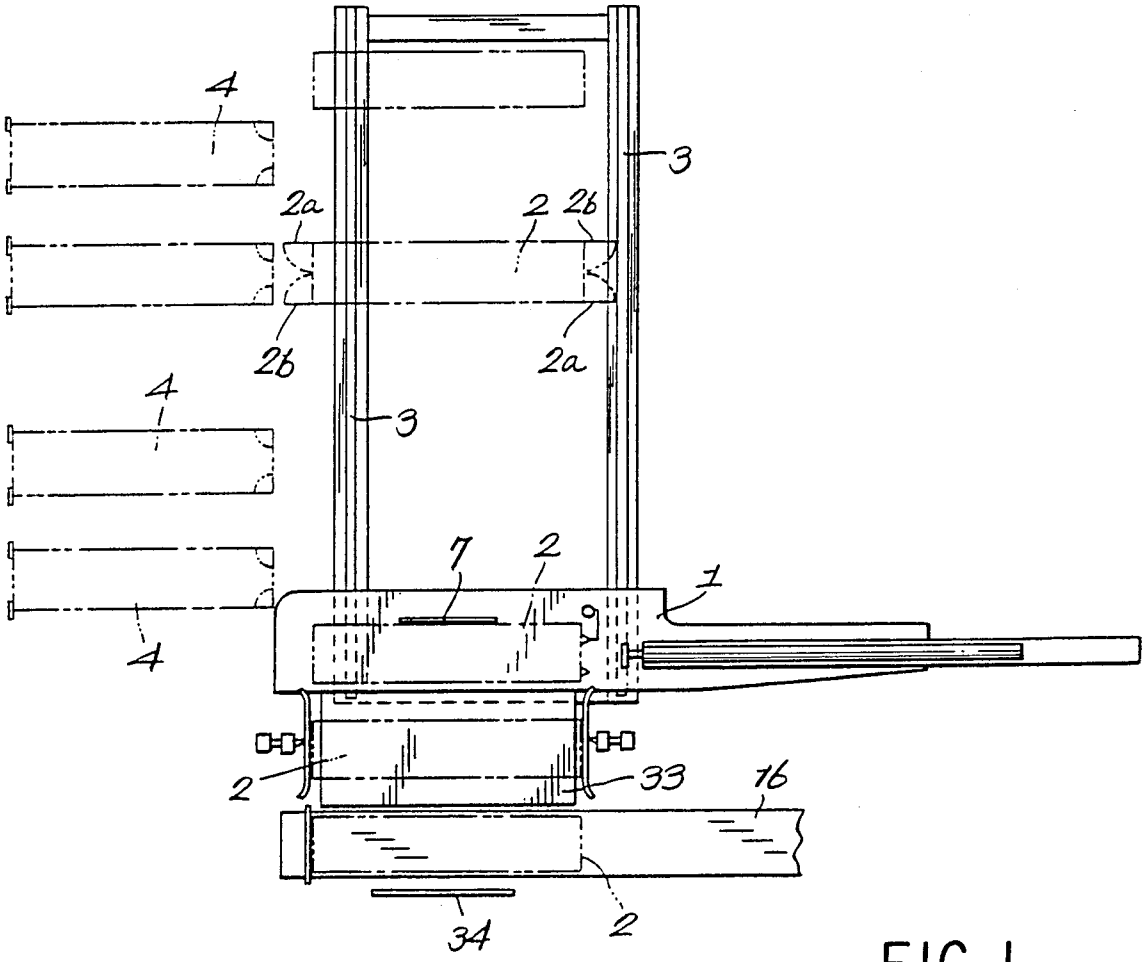
FIG. 1 of the accompanying drawings shows a plan view of a device for laterally cutting a carton container case in a carton automatic feeder for a liquid filling machine with the present invention.
Figure 2:
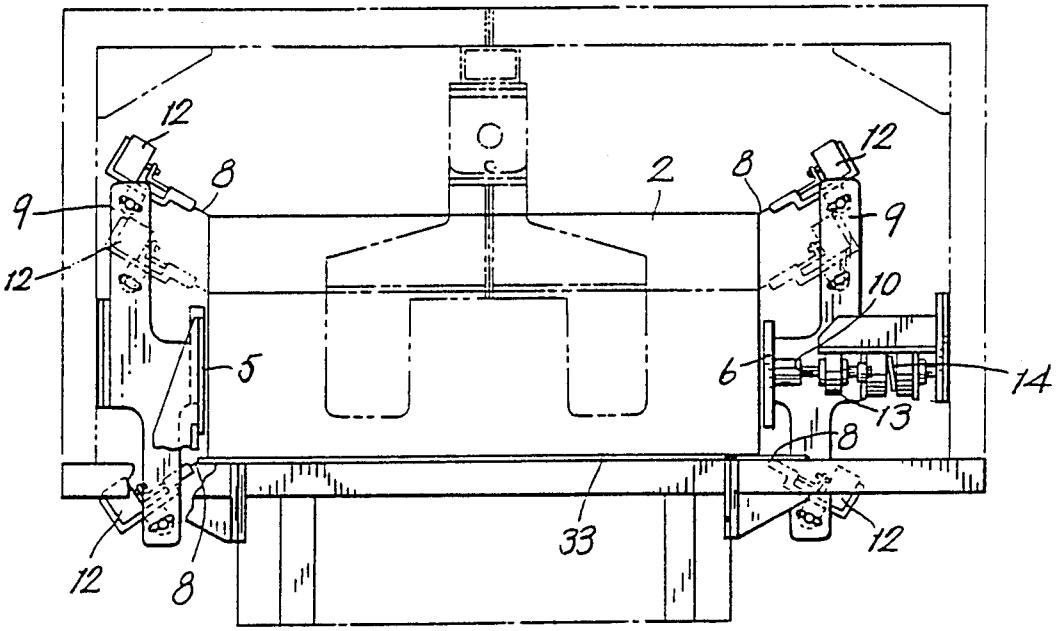
FIG. 2 is a front view of the device, FIG. 3 a perspective view of the case, FIG. 4 a side view of the case, FIG. 5 a plan view of the case.

In FIG. 1, a carrier 1 is provided to support an elongate case 2 containing cartons. The carrier 1 moves on rails 3 and 3, and the case 2 is displaced so as to face any desired one of the baskets 4 which are located in a row along the rail 3. Before being transferred to the carrier 1, the case 2, is pushed by a pusher 34, at a right angle to the longitudinal axis of the case 2. The case is thrust by the pusher 34 laterally to the longitudinal direction of the case 2 and transferred on the plate 33 until the case is received by a stopper 7 on the carrier 1. During the transfer on the plate 33, the lateral motion of the case 2 is restricted by guide plates 5 and 6 as shown in FIG. 2.

Cutters 8, four in total, are installed radially at an inclined angle to the upper and lower corners of the case ends. Holders 9 are provided which securely fix the cutters 8.

Figure 3:
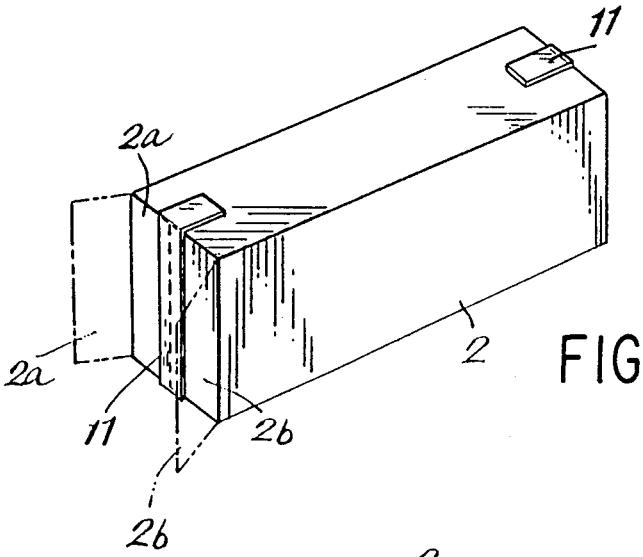
Figure 4:
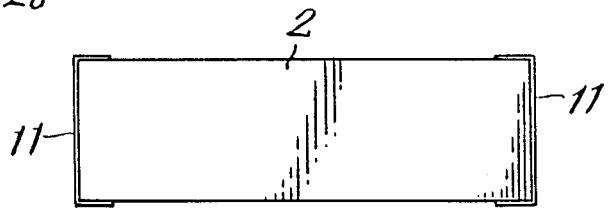
Figure 5:
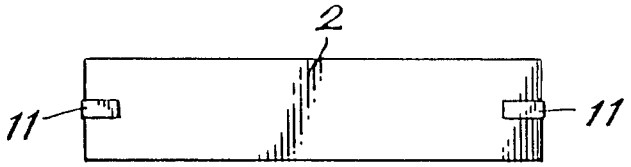

As shown in FIG. 3, the case 2 is provided with outer flaps **2*a* and 2*b* which are opened by right and left turns respectively on both ends of the case. Both ends of an adhesive tape 11 have been bonded on the case 2 over the upper and lower end face edges to keep the flaps 2*a* and 2*b* closed. The tips of the cutters 8 are located so as to be opposed to the boundary or edge between the flap and the upper side of the case 2 and the boundary or edge between the flap and the lower side of the case 2**.

Each of the cutters 8 is attached to an air cylinder 12 of a compact type so that the blade tip of the cutter can be extended and retracted quickly through a short distance.

The movement of the case 2 is detected by a photo sensor and the cutters 8 extend the blade tips only when the cutters are performing the lateral cutting of the tape 11 applied onto upper and lower end face edges of the case which moves across the plate 33, and also retract the blade tips before and after the cutting of the tape so that the case may not be cut except where the tape 11 is present.

With reference to the guide plates 5 and 6, the plate 5 is stationary and the plate 6 is movable. Linear shafts 10 which support the guide plate 6 are retracted along bearings 13, and are biased to return by a spring 14. By this mechanism, even with variations in the length of the cases 2, the position of the cutters 8 above plate 6 automatically change to accommodate variations in the length of the cases 2 so as to prevent excessive protrusion of the blade tips and also provide reliable lateral cutting of the tape.

Additionally, the cutter device is provided with two sets of cutters in the upper position with the lower pair of cutters shown in FIG. 2 by chain lines so as to accommodate for the difference in the height of the cases 2 as determinend by the type of cases, and automatically extends the right set of cutters appropriate for the type of cases by identifying the type of case with a photo sensor.

Figure 6:
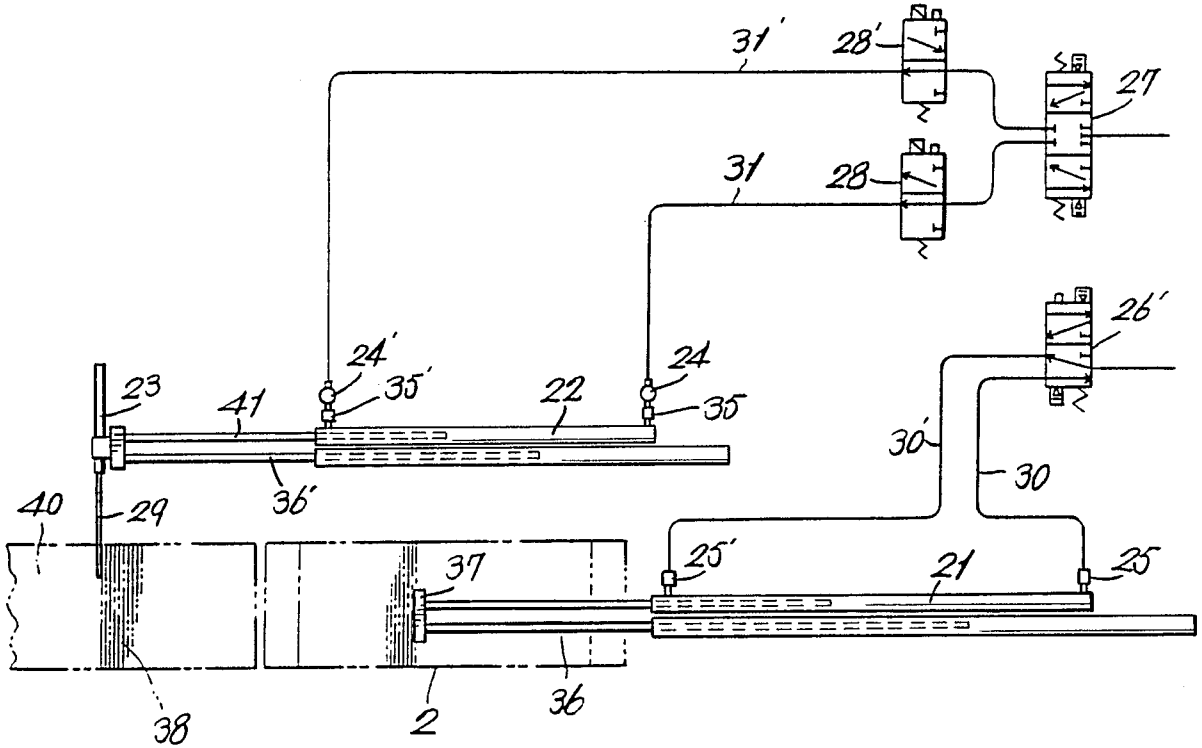
FIG. 6 shows a side view of a support device to transfer as well as support the cartons in said case after the carton flaps have been opened by longitudinal cutting after the flaps were laterally cut by the device for laterally cutting.

FIG. 6 shows a carton support device used in packing or handling superposed cartons removed from cases which have been laterally cut at the upper and lower portion of the tape by the device for laterally cutting tapes and then longitudinally cut at the center of the tape, although not shown in the figure, to open the outer flaps in right and left turn, so as to remove from the operator the labor required to manipulate the cartons. FIG. 6 shows an air cylinder 21 for a carton pusher, a low friction air cylinder 22 for carton support, and an air cylinder 23 providing a carton support bar 29.

In the air cylinder 21, carton pusher speed control valves 25 and 25' are provided at the ends of the cylinder 21 and communicate via air pipings 30 and 30' to a 5 way valve 26' connected to a compressed air source. A low friction carton support air cylinder 22 is provided with speed control valves 35 and 35', and quick exhaust valves 24 and 24', which communicate with a 5-way valve 27 of a closed center type connected to the compressed air source through air pipings 31 and 31' via 3-way valves 28 and 28'. The cylinders 21 and 22 are provided with guide bars 36 and 36' respectively, and a carton pusher plate 37 and carton support bar 29 are also provided.

FIG. 6 is also a piping diagram which illustrates the state where the cartons 38 are extruded from the case 2 to be transferred to the basket 40 of the automatic feeding device and the carton support cylinder 22 extrudes the carton support bar cylinder 23 up to the prescribed position and then stops. At the same time the 5-way valve 21 is closed. That is, the entrance and discharge of compressed air have been interrupted, and the 3-way vales 28 and 28' release the air in the pipings 31 and 31' into the atmosphere.

Because the quick exhaust valves 24 and 24' serve to effect quick discharge of air from the low friction air cylinder for carton support, the low friction air cylinder 22 for carton support is in a completely free state.

Subsequently the cylinder 23 for carton support bar descends, and the carton support bar 29 attached to the tip of the piston rod of the carton support bar cylinder 23 waits for the cartons to be extruded at the outlet of the carton case 2.

The carton pusher air cylinder 21 begins to proceed forward after the outer flaps of the carton case 2 have been opened by a flap opener. Subsequently the cartons are extruded from the case, and supported by the carton support bar 29 before the extruded cartons tumble. The cartons 38 are pushed by the carton pusher plate 37, while also blocked by the carton support bar 29 and the reaction of this action thrusts on the carton support bar 29. When the thrust force reaches a certain magnitude, it performs an action to draw out the piston rod 41 of the carton support air cylinder 22. Because the carton support air cylinder 22 is a special cylinder made to have a low friction between its piston and cylinder, the piston rod 41 transfers the cartons smoothly keeping pace with the movement of the carton pusher 37 and grasping the cartons between the support bar 29 and the pusher plate 37 so as to displace the cartons up to the carton basket 40.

When the piston rod 41 of the air cylinder 22 has been drawn out to its extremity, an auto-switch mounted on the end of the air cylinder 22 is actuated so that the piston rod of the air cylinder 23 and support bar 29 are elevated to leave the cartons; and then the 3-way valves 28 and 28' return to the original state from the open state, and the 5-way valve 27 changes over the air circuit so as to retract the piston rod. The air cylinder 21 is also retracted to the original state. The above-mentioned series of operations perform the actions to transfer the cartons quickly and smoothly to a prescribed position without applying adverse forces onto the cartons and also without causing the cartons to tumble.

A device in accordance with the present invention is capable of reliably cutting only the necessary portion of the adhesive tape at an inclined angle so as to prevent early blunting of the blade tips and effect a smooth operation of carton feeding.

Additionally the device is capable of transferring the cartons to a prescribed position without tumbling them.

What is claimed is:

1. A device for moving a stack of folded cartons from a first container to a second container comprising:

a first cylinder and first piston including means for contacting one end of a stack of folded cartons in a first container and pushing said stack of cartons in one direction toward a second container, and a second cylinder and second piston including means for contacting an end of said stack of folded cartons opposite from said one end and following said pushing movement of said first cylinder means, whereby said first and second cylinder means cooperate to move said stack of folded cartons to said second container and a reaction force between said first cylinder pushing means and said second cylinder means prevents individual ones of said cartons from tumbling out of said stack during said movement.

2. The device defined by claim 1, wherein said first piston is movable relative to said first cylinder and said means for contacting one end of said stack of folded cartons is a plate fixed to an end of said first piston.

3. The device defined by claim 1, wherein said second piston is movable relative to said second cylinder and said means for contacing said end of said stack of folded cartons opposite from said one end is movably mounted to one end of said second piston for movement in a direction normal to the direction said stack of cartons is pushed so as to be selectively moved into and out of contact with said opposite end of said stack.

4. The device defined by claim 3, wherein a cylinder is mounted to said one end of said second piston and said means for contacting said end of said stack of folded cartons opposite from said one end is a support member fixed to a piston movable relative to said cylinder mounted to said one end of said second piston.

5. The device defined by claim 1, wherein said first and second pistons are movable relative to said first and second cylinders respectively and further including first and second guide bars adjacent said first and second pistons respectively, means slidably mounting said first and second guide bars for movement in parallel with said first and second pistons respectively, said first cylinder means for contacting one end of said stack of folded cartons is mounted to spaced adjacent ends of said first piston and said first guide bar and said second cylinder means for contacting the opposite end of said stack of folded cartons is mounted to spaced adjacent ends of said second piston and said second guide bar.

* * * * *